US011278899B2

(12) United States Patent
Zhao et al.

(10) Patent No.: US 11,278,899 B2
(45) Date of Patent: Mar. 22, 2022

(54) MICROFLUIDIC PARTICLE AND MANUFACTURING METHOD THEREOF, MICROFLUIDIC SYSTEM, MANUFACTURING METHOD AND CONTROL METHOD THEREOF

(71) Applicants: Beijing BOE Optoelectronics Technology Co., Ltd., Beijing (CN); BOE TECHNOLOGY GROUP CO., LTD., Beijing (CN)

(72) Inventors: Wei Zhao, Beijing (CN); Chunlei Wang, Beijing (CN)

(73) Assignees: Beijing BOE Optoelectronics Technology Co., Ltd., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 169 days.

(21) Appl. No.: 16/384,227

(22) Filed: Apr. 15, 2019

(65) Prior Publication Data

US 2020/0070171 A1 Mar. 5, 2020

(30) Foreign Application Priority Data

Aug. 28, 2018 (CN) ..... 201810988070.0

(51) Int. Cl.
*B01L 3/00* (2006.01)

(52) U.S. Cl.
CPC ... *B01L 3/502784* (2013.01); *B01L 3/502707* (2013.01)

(58) Field of Classification Search
CPC ..... B01L 3/502784; B01L 3/502707
See application file for complete search history.

(56) References Cited

U.S. PATENT DOCUMENTS 9,223,317 B2 12/2015 Winger
2009/0068170 A1* 3/2009 Weitz ..... G01N 33/5052 424/130.1

(Continued)

FOREIGN PATENT DOCUMENTS

CN 101773814 A 7/2010
CN 102474023 5/2012

(Continued)

OTHER PUBLICATIONS

1st Office Action dated Jul. 27, 2020 for Chinese Patent Application No. 201810988070.0.

(Continued)

*Primary Examiner* — Jennifer Wecker
*Assistant Examiner* — Oyeleye Alexander Alabi
(74) *Attorney, Agent, or Firm* — Thomas | Horstemeyer, LLP

(57) ABSTRACT

The present disclosure relates to the field of digital microfluidics, and provides a microfluidic particle comprising a charged droplet, an intermediate cladding layer, and a dielectric surface layer. The intermediate cladding layer is hydrophobic and coated outside the charged liquid droplet. The dielectric surface layer is hydrophilic and is coated outside the intermediate cladding layer. A microfluidic system is also provided, where the microfluidic system comprises a digital microfluidic chip and the microfluidic particle is disposed above the digital microfluidic chip.

13 Claims, 4 Drawing Sheets

(56) References Cited

U.S. PATENT DOCUMENTS

| | | | | |
|---|---|---|---|---|
| 2012/0104333 | A1* | 5/2012 | Takai | B22F 1/025 252/513 |
| 2015/0008123 | A1* | 1/2015 | Cheng | G02B 26/005 204/450 |
| 2016/0296934 | A1* | 10/2016 | Dong | B01L 3/502784 |

FOREIGN PATENT DOCUMENTS

| | | | |
|---|---|---|---|
| CN | 102499892 | | 6/2012 |
| CN | 102553065 | | 7/2012 |
| CN | 102573797 | A | 7/2012 |
| CN | 202893370 | | 4/2013 |
| CN | 103343090 | A | 10/2013 |
| CN | 103386332 | | 11/2013 |
| CN | 106117458 | | 11/2016 |
| CN | 106890683 | A | 6/2017 |
| CN | 108226261 | A | 6/2018 |

OTHER PUBLICATIONS

Second Office Action for CN Patent Application No. 201810988070.0 dated Apr. 9, 2021.

* cited by examiner

MICROFLUIDIC PARTICLE AND MANUFACTURING METHOD THEREOF, MICROFLUIDIC SYSTEM, MANUFACTURING METHOD AND CONTROL METHOD THEREOF

CROSS-REFERENCE TO RELATED APPLICATION

The present application is based upon, claims the benefit of, and claims priority to Chinese Patent Application No. 201810988070.0, filed on Aug. 28, 2018, the entire disclosure of which is hereby incorporated by reference herein as a part of the present application.

FIELD OF THE INVENTION

The present disclosure relates to the field of digital microfluidic technology, in particular to a microfluidic particle and a manufacturing method thereof, a microfluidic system having the same, a manufacturing method, and a control method thereof.

BACKGROUND

With the development of Micro-Electro-Mechanical System (MEMS) technology, digital microfluidic chips have made breakthroughs in the driving and control technologies of microdroplets, and have been widely used in the fields of biology, chemistry, and medicine by virtue of their own advantages. Samples such as various cells can be cultured, moved, and analyzed in a digital microfluidic chip. As can be seen from the wide range of applications in various fields, digital microfluidic chips have the advantages of small size, small reagent usage, fast response, easy to carry, parallel processing and easy automation.

The above information disclosed in this Background section is only used to enhance an understanding of the background of the present disclosure, and thus it may include information that does not constitute prior art known to those of ordinary skill in the art.

BRIEF SUMMARY OF THE INVENTION

The objective of the present disclosure is to provide a fluid microparticle, a manufacturing method thereof, a microfluidic system having the microfluidic particle, a manufacturing method thereof and a control method thereof.

Additional aspects and advantages of the present disclosure will be set forth in part in the following description, and will partly become apparent from the description, or may be learned from practice of the present disclosure.

According to an aspect of the present disclosure, a microfluidic particle is provided, including:

a charged droplet;

an intermediate cladding layer having hydrophobicity and coated outside the charged droplet; and a dielectric surface layer having hydrophilicity and coated outside the intermediate cladding layer.

In an exemplary embodiment of the present disclosure, the intermediate cladding layer includes: carboxymethylcellulose or soy protein isolate.

In an exemplary embodiment of the present disclosure, the charged droplet has positive charges.

In an exemplary embodiment of the present disclosure, the dielectric surface layer includes: a silica nanoparticle.

In an exemplary embodiment of the present disclosure, the charged droplet has a volume larger than or equal to 0.1 $mm^3$ and smaller than or equal to 10 $mm^3$, the intermediate cladding layer has a thickness larger than or equal to 1 nm and smaller than or equal to 10 nm, and the dielectric surface layer has a thickness larger than or equal to 1 nm and smaller than or equal to 10 nm.

According to an aspect of the present disclosure, a microfluidic system is provided, including:

a digital microfluidic chip; and the microfluidic particle according to any one of the above, which is provided on the digital microfluidic chip.

In an exemplary embodiment of the present disclosure, the digital microfluidic chip includes:

a substrate;

an electrode having a hydrophobic surface disposed over the substrate, wherein the electrode is in direct contact with the flow channel, and the flow channel contains the microfluidic particle.

In an exemplary embodiment of the present disclosure, the electrode is made of graphene.

According to an aspect of the present disclosure, a method for manufacturing a microfluidic particle is provided, including:

forming a charged droplet;

coating a hydrophobic intermediate cladding layer outside the charged droplet; and coating a hydrophilic dielectric surface layer outside the intermediate cladding layer.

According to an aspect of the present disclosure, a method for manufacturing a microfluidic system is provided, including:

forming a microfluidic particle by the method for manufacturing a microfluidic particle described above;

forming a digital microfluidic chip having a hydrophobic surface; and dropping the microfluidic particle onto the hydrophobic surface of the digital microfluidic chip.

In an exemplary embodiment of the present disclosure, the material of an electrode of the digital microfluidic chip is graphene.

According to an aspect of the present disclosure, a method for driving a microfluidic system is provided, including:

changing a voltage of electrodes to drive a microfluidic particle according to the present disclosure to move.

It should be understood that both the foregoing general description and the following detailed description are exemplary and explanatory only and are not restrictive of the disclosure.

BRIEF DESCRIPTION OF THE DRAWINGS

The above and other features and advantages of the present disclosure will become more apparent from the detailed description of the exemplary embodiments with reference to accompanying drawings.

DETAILED DESCRIPTION

Figure 1:
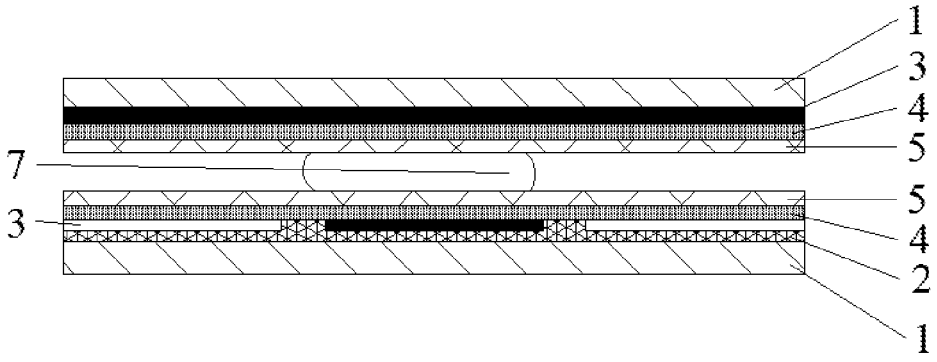
FIG. 1 is a schematic diagram showing the structure of a cartridge-type microfluidic system.

Example embodiments will now be described more fully with reference to the accompanying drawings. However, the example embodiments can be embodied in a variety of forms and should not be construed as being limited to the embodiments set forth herein. Rather, these embodiments are provided to make the present disclosure thorough and complete, and to fully convey the concepts of the exemplary embodiments to those skilled in the art. The same reference numerals in the drawings denote the same or similar structures, and thus their detailed description will be omitted.

Figure 2:
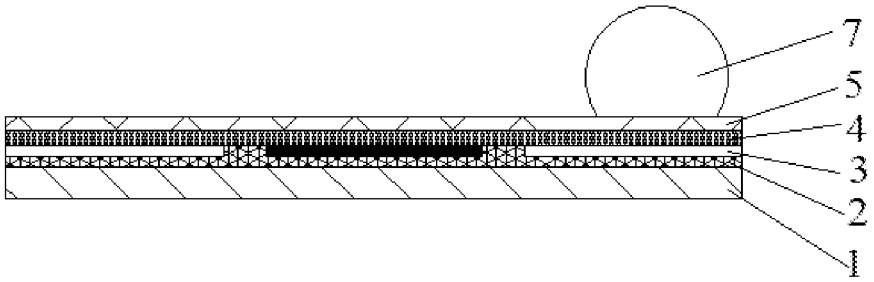
FIG. 2 is a schematic diagram showing the structure of an open-type microfluidic system.

Referring now to the drawings, schematic diagrams of cartridge-type and open-type microfluidic systems are shown in FIGS. 1 and 2. The microfluidic system includes a substrate 1, an insulating layer 2, an electrode layer 3, a dielectric layer 4, a hydrophobic layer 5, and a microdroplet 7. Nowadays, the manufacturing process of the digital microfluidic chip is complicated in that the electrode layer is usually formed by deposition, the dielectric layer is formed by an evaporation process, and then a coating layer is prepared as a hydrophobic layer by spin coating and baking. During operation, usually to manipulate the microdroplet 7, the operating voltage may reach 100V or more, and a strong electric field will be formed in the digital microfluidic chip which can cause irreversible damage to active substances such as cells, DNAs, and proteins contained in the microdroplet 7. Therefore, the operating voltage of the chip must be lowered.

The present disclosure first provides a microfluidic particle 6, which may include a charged droplet 61, an intermediate cladding layer 62, and a dielectric surface layer 63. The intermediate cladding layer 62 is hydrophobic and is coated outside the charged droplet. The dielectric surface layer 63 is hydrophilic and is coated outside intermediate cladding layer 62.

In the present exemplary embodiment, the charged droplet 61 is a strongly hydrophilic substance, and the charged droplet 61 can be positively charged. However, in other exemplary embodiments of the present disclosure, the charged droplet 61 may also be negatively charged.

In the present example embodiment, since the charged droplet 61 is a strongly hydrophilic substance, a highly hydrophobic intermediate cladding layer 62 is required to clad it. The intermediate cladding layer 62 may be a strongly hydrophobic organic material. For example, the intermediate cladding layer 62 may include carboxymethyl cellulose or soy protein isolate or the like.

In the present example embodiment, since the intermediate cladding layer 62 is strongly hydrophobic, a hydrophilic dielectric surface layer 63 is required to clad it. For example, the dielectric surface layer 63 may include a silica nanoparticle.

The intermediate cladding layer 62 is coated outside the charged liquid droplet 61, and the dielectric surface layer 63 is coated outside the intermediate cladding layer 62 to form an oil-in-water-in-oil structure, which is a neutral microcapsule structure with a hydrophilic outer surface and a hydrophobic inner surface. The thickness of the intermediate cladding layer 62 and the dielectric surface layer 63 is much smaller than the thickness of the dielectric layer in the related art, so that the voltage for controlling the microfluidic particle can be low and irreversible damage caused to active substances, such as cells, DNAs, and proteins contained in the microdroplet, can be avoided.

The volume of the charged droplet 61 is larger than or equal to 0.1 $mm^3$ and smaller than or equal to 10 $mm^3$, the thickness of the intermediate cladding layer 62 is larger than or equal to 1 nm and smaller than or equal to 10 nm, and the thickness of the dielectric surface layer 63 is larger than or equal to 1 nm and smaller than or equal to 10 nm.

Further, the present disclosure also provides a microfluidic system. Referring to the structural schematic diagram of FIG. 3, an embodiment of the microfluidic system of the present disclosure is shown, which may include a digital microfluidic chip and the above described microfluidic particle 6. The specific structure of the microfluidic particle 6 has been described in detail above, and therefore will not be repeated herein.

Figure 3:
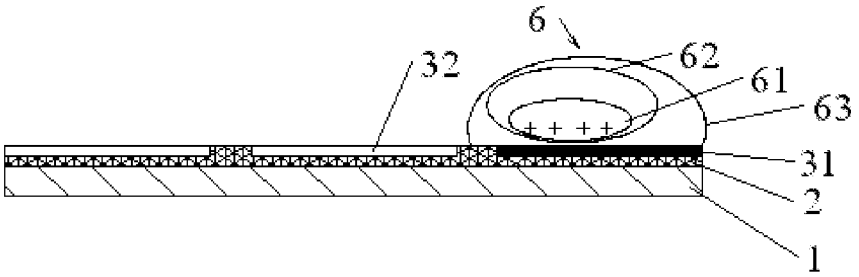
FIG. 3 is a schematic diagram showing the structure of an embodiment of a microfluidic system of the present disclosure.

In the present example embodiment, the digital microfluidic chip may further include a substrate 1, an insulating layer 2, and an electrode layer 3. The insulating layer 2 is disposed on the substrate 1, and the electrode layer 3 is disposed on the insulating layer 2. The main component of the substrate 1 may be silicon or glass. The main component of the insulating layer 2 may be silicon dioxide, or may be an insulating material such as silicon nitride or silicon oxynitride. A plurality of grooves are formed in the insulating layer 2, and the electrode layers 3 are respectively provided in the grooves so that the plurality of electrodes are insulated from each other. A flow path for containing the microfluidic particle 6 and for passing the microfluidic particle 6 through is formed on the digital microfluidic chip, and the electrodes are in direct contact with the flow path. That is, the flow path provides a passage for the microfluidic particle 6, and the electrodes provide a driving force for the microfluidic particle 6. The plurality of electrodes may form a ground reference electrode 32 and a high level electrode 31 by connecting to different potentials, and the ground reference electrode 32 and the high level electrode 31 may be spaced apart. In FIG. 3, the black electrode is the high level electrode 31, and the white electrode is the ground reference electrode 32. In the present disclosure, the high level electrode 31 represents an electrode with an absolute value of the potential higher than that of the potential of the ground reference electrode 32. Additionally, the ground reference electrode 32 is not limited to being "connected to the ground," but can be connected to any fixed reference potential.

Figure 4:
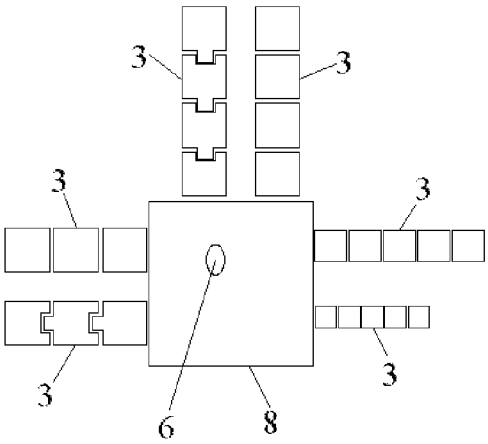
FIG. 4 is a plan view of an electrode in the microfluidic system of the present disclosure.

Referring to the schematic plan view of the electrode in the microfluidic system of the present disclosure, shown in FIG. 4, the microfluidic particle 6 is stored in a reservoir 8, and a plurality of electrode groups may be disposed at the periphery of the reservoir 8. The electrode group may include a plurality of electrodes sequentially arranged in a predetermined shape to form flow paths having different planar shapes. The electrodes may be provided in a variety of shapes such as a rectangle or a square. The electrode may also be provided with a recess on one side and a protrusion on the other side, and, for adjacent two electrodes, the protrusion of one electrode extends into the recess of the other electrode so as to facilitate the transport of the microfluidic particle 6 to the next electrode. The size of the electrode is generally larger than or equal to 0.5 mm×0.5 mm and smaller than or equal to 2 mm×2 mm or less, and the interval between two adjacent electrodes is larger than or equal to 10 μm and smaller than or equal to 100 μm.

In the present exemplary embodiment, the electrode layer 3 has a hydrophobic surface, and the material of the electrode layer 3 is graphene, which is strongly hydrophobic and electrically conductive. The electrode layer 3 is in direct contact with the surface of the microfluidic particle 6, and the microfluidic particle 6 having hydrophilicity on the outer surface can have a strong tension on the surface of the graphene electrode to form a circular microcapsule. Graphene is used as an electrode and as a hydrophobic layer medium, so the high conductivity and hydrophobicity of graphene can be utilized. Together with the structure of the microfluidic particle 6, a dielectric layer 4 and a hydrophobic layer 5 are no longer required in the manufacturing process of the digital microfluidic chip, which can reduce the two manufacturing processes and greatly simplify the device structure and the manufacturing process.

Figure 5:
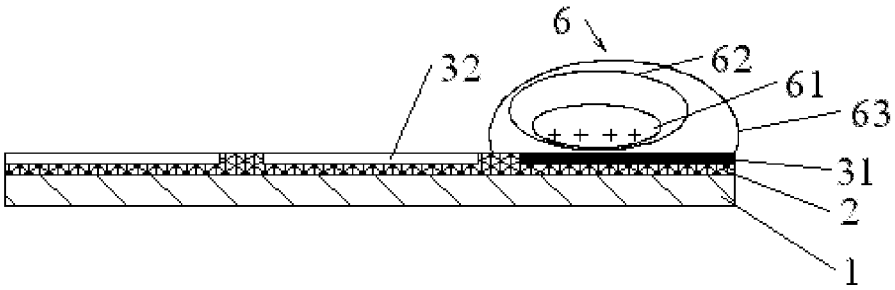
FIG. 5 is a schematic diagram showing the structure of the microfluidic particle in FIG. 3 in an initial state.
Figure 6:
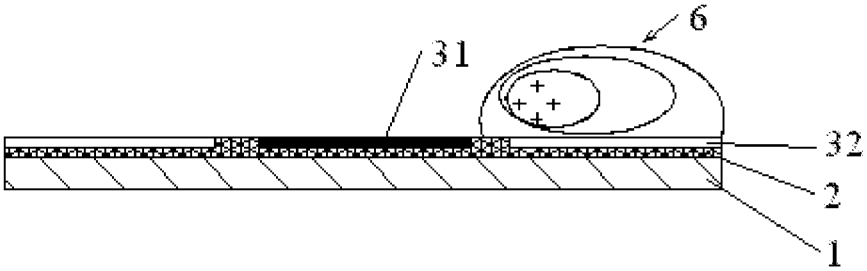
FIG. 6 is a schematic diagram showing the structure in which the charges start to move for charge accumulation in the microfluidic particle of FIG. 5.
Figure 7:
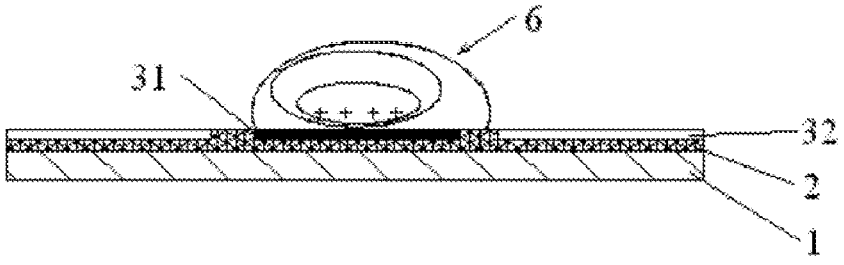
FIG. 7 is a schematic diagram showing the structure of the microfluidic particle in FIG. 6 when the resultant force of the electrostatic forces is zero.
Figure 8:
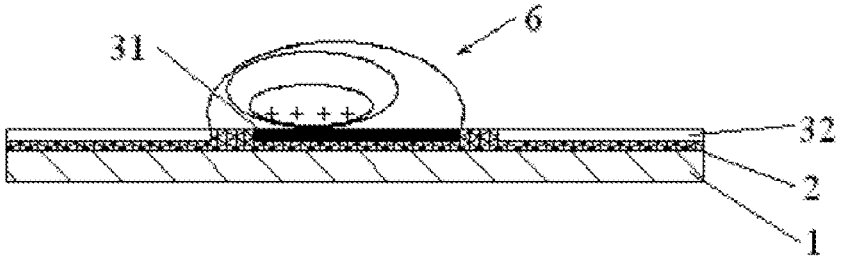
FIG. 8 is a schematic diagram showing the structure of the microfluidic particle of FIG. 7 after being continuously moved by inertia.

Referring to the structural diagram of the microfluidic particle 6 in FIG. 4, which is shown in FIG. 5 in an initial state, the microfluidic particle 6 is on the high level electrode 31 due to the electrostatic action. Referring to FIG. 6, a schematic diagram of the structure in which the charges in the microfluidic particle 6 in FIG. 5 starts to move due to charge accumulation. After the electrode voltage is changed, the positive charges are concentrated to the left side of the microfluidic particle 6 by the electrostatic force, and the microfluidic particle 6 starts to move to the left under the action of the left electrostatic force. Referring to the structural diagram of the microfluidic particle 6 in FIG. 6, as shown in FIG. 7, when the microfluidic particle 6 moves to a position where the resultant electrostatic force is zero, and when the microfluidic particle 6 moves to the ground reference electrode 32, the resultant electrostatic force of the microfluidic particle 6 is zero. Referring to FIG. 8, a schematic structural diagram of the microfluidic particle 6 of FIG. 7 is shown continuing to move under the action of inertia, is shown where the microfluidic particle 6 will continue to move to the left by a certain distance under the action of inertia. By now, the microfluidic particle 6 completes one move between adjacent electrodes. The above process is repeated to realize digital driving of the droplet.

There are many commonly used driving methods for digital microfluidic chips, such as electrowetting, dielectrophoresis, surface acoustic wave and electrostatic force on the medium. However, each driving method has disadvantages, for example, the electrostatic driving force of the chip is higher.

Reducing the driving voltage mainly reduces the two aspects of the motion resistance and the driving force.

First, to reduce the motion resistance, the free energy of the hydrophobic layer surface is reduced, that is, by increasing the solid-liquid contact angle. Studies have shown that the best fluorocarbon polymer has a solid-liquid contact angle of about 115°, while graphene has excellent hydrophobicity and has a solid-liquid contact angle of about 130° or more, which can effectively reduce the motion resistance.

Figure 9:
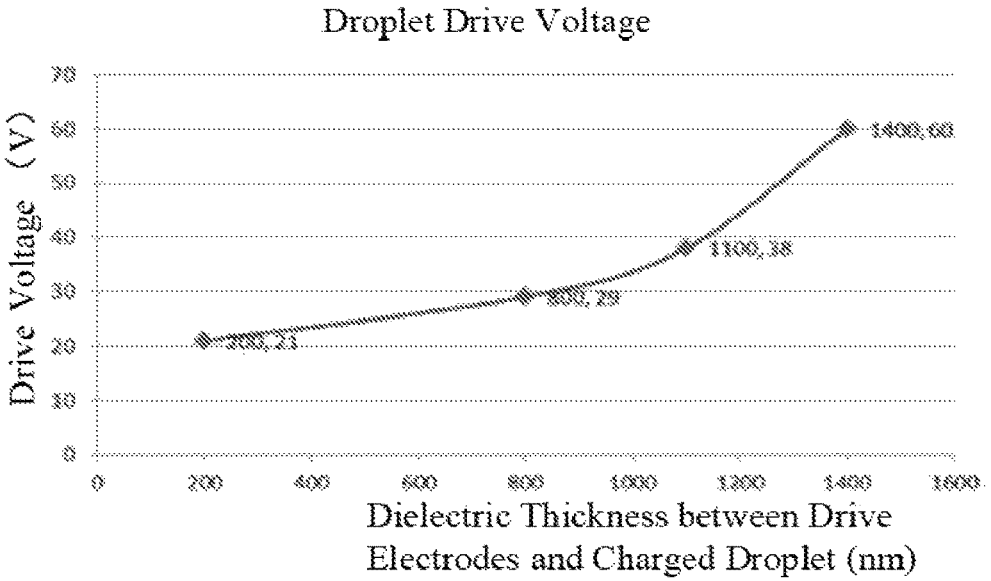
FIG. 9 is a graph showing a relationship between a driving voltage of charged droplet and a dielectric thickness between a driving electrode and the charged droplet.

Secondly, in terms of increasing the driving force, based on the electrostatic force driving, the magnitude of the electrostatic force received by the charged droplet 61 is closely related to the thickness of the dielectric between the charged droplet 61 and the driving electrodes. Referring to the relationship between the driving voltage of the charged liquid droplet 61 and the dielectric thickness between the driving electrode and the charged liquid droplet 6 shown in FIG. 9, within a certain range, reducing the dielectric thickness can effectively increase the driving force, thereby lowering the driving voltage. The thinner the dielectric is, the smaller the driving voltage is. The electrostatic force formula is as follows:

$$F = \frac{kq_1q_2}{r^2}$$

where r denotes a distance between the first charge and the second charge, F denotes an electrostatic force, $q_1$ denotes an amount of electricity of the first charge, $q_2$ denotes an amount of electricity of the second charge, and k is a coefficient which is constant.

In the case where the remaining conditions are constant, the smaller the r is, the larger the electrostatic force. Therefore, the smaller the required driving force, the smaller the voltage is required to drive. In the microfluidic system of the present disclosure, the intermediate cladding layer 62 and the dielectric surface layer 63 in the microfluidic particle 6 are taken as a dielectric, the thickness of the intermediate cladding layer 62 is very thin (may be produced to below about 10 nm). The thickness of the dielectric surface layer 63 is very thin (may be produced to below about 10 nm), much thinner than the conventional dielectric layer (about 1 um or so) which cannot be made thinner by the limitations of the manufacturing process. Therefore, the present disclosure can effectively reduce the driving voltage.

Moreover, graphene has high conductivity and smaller resistance than the conventional metal electrode material, which can further reduce the driving voltage.

Figure 10:
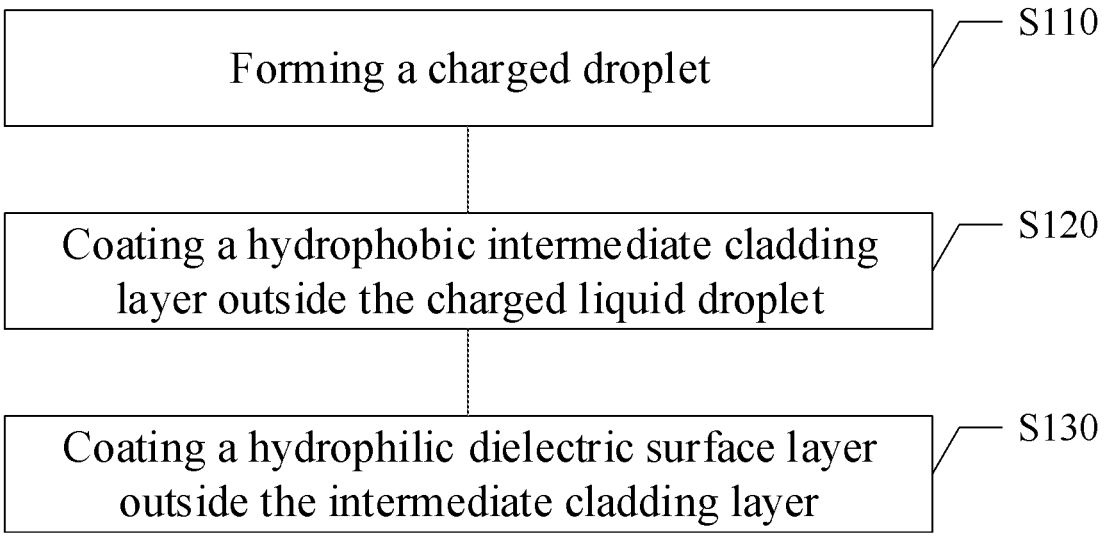
FIG. 10 is a schematic flow chart showing a method for manufacturing a microfluidic particle of the present disclosure.

In addition, the present disclosure further provides a method for manufacturing the microfluidic particle 6. Referring to the flow chart of FIG. 10, a method for manufacturing the microfluidic particle 6 of the present disclosure is shown, where the method for manufacturing the microfluidic particle 6 may include the following steps.

In step S110, a charged droplet 61 is formed.

In step S120, a hydrophobic intermediate cladding layer 62 is coated outside the charged liquid droplet 61.

In step S130, a hydrophilic dielectric surface layer 63 is coated outside the intermediate cladding layer 62.

The method for manufacturing the microfluidic particle 6 will be described in detail below.

In step S110, a charged droplet 61 is formed.

In the present exemplary embodiment, the positively charged droplet preparation is achieved by adding positively charged ions to the dispersed phase. For example, sunflower oil can be used as the continuous phase and the chitosan mixture containing Fe3+/Fe2+ can be used as the dispersed phase. The positively charged chitosan droplet used to study the chitosan polymer is synthesized.

In step S120, a hydrophobic intermediate cladding layer 62 is coated outside the charged liquid droplet 61.

In step S130, a hydrophilic dielectric surface layer 63 is coated outside the intermediate cladding layer 62.

After the above described charged liquid droplet 61 is formed, the intermediate cladding layer 62 and the dielectric surface layer 63 may be sequentially formed by a high-speed stirring method, a layer-by-layer deposition method, a film emulsification method, an interfacial polymerization method, or the like. That is, by replacing the chemical agents used for the reaction with the materials for forming the intermediate cladding layer 62 and the dielectric surface layer 63, a controlled preparation of the microparticle material having the intermediate cladding layer 62 and the dielectric surface layer 63 can be realized.

Figure 11:
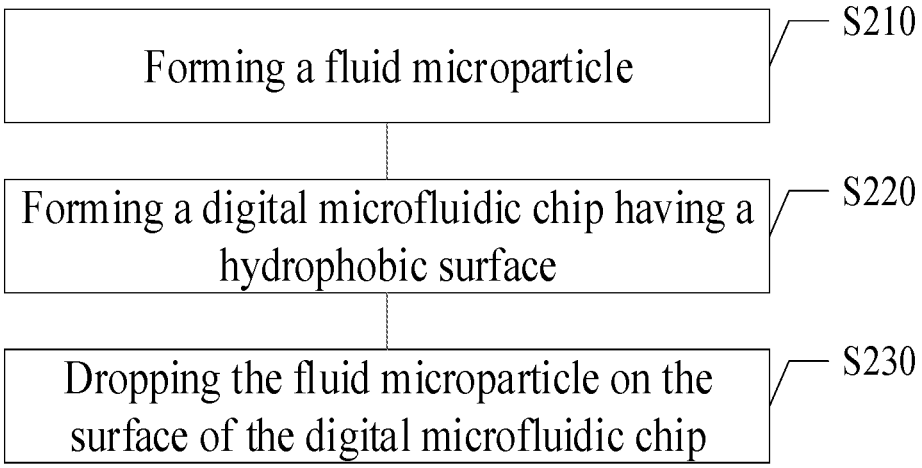
FIG. 11 is a schematic flow chart showing a method for manufacturing the microfluidic system of the present disclosure.

Further, the present disclosure also provides a method for manufacturing a microfluidic system. Referring to the flow chart of the method for manufacturing the microfluidic system, shown in FIG. 11, the method for manufacturing the microfluidic system may include the following steps.

In step S210, a microfluidic particle 6 is prepared according to the above-described method for manufacturing the microfluidic particle 6.

In step S220, a digital microfluidic chip having a hydrophobic surface is formed.

In step S230, the microfluidic particle 6 is dropped on the surface of the digital microfluidic chip.

The manufacturing method of the microfluidic system will be described in detail below.

In step S210, the microfluidic particle 6 is prepared according to the above-described method for manufacturing the microfluidic particle 6. The manufacturing method of the microfluidic particle 6 has been described in detail above, and therefore, it will not be described herein.

In step S220, a digital microfluidic chip having a hydrophobic surface is formed.

In the present exemplary embodiment, first, the substrate 1 is formed, and the main component of the substrate 1 may be silicon or glass. Next, an insulating layer 2 is formed on the substrate 1. The main component of the insulating layer 2 may be silicon dioxide, silicon nitride, silicon oxynitride or the like. For example, silicon dioxide, silicon nitride, silicon oxynitride, etc. can be formed by a deposition process. The thickness of the insulating layer 2 is about 0.1 to 1 um. The insulating layer 2 is etched to form a plurality of grooves. Then, an electrode layer 3 is formed on the insulating layer 2 by deposition, and the material of the electrode layer 3 is graphene. The electrode layer 3 is etched to retain the electrode material in the groove, and the electrode material outside the groove is removed to insulate the plurality of electrodes from each other.

In step S230, the microfluidic particle 6 is dropped on the surface of the digital microfluidic chip. The dropping method of the microfluidic particle 6 is a dropping method of a droplet in the related art, and therefore, will not be described herein.

Further, the present disclosure also provides a driving method of a microfluidic system. After the microfluidic particle 6 is dropped on the surface of the electrode layer 3, the voltage of the electrode layer 3 is changed to drive the microfluidic particle 6 to move. The driving method of the microfluidic particle 6 has been described in detail in the description of the above described microfluidic system and, therefore, will not be repeated herein.

The features, structures, or characteristics described above may be combined in any suitable manner in one or more embodiments, and the features discussed in the various embodiments are interchangeable, if possible. In the above description, numerous specific details are set forth to provide a thorough understanding of the embodiments of the present disclosure. However, one skilled in the art will appreciate that the technical solution of the present disclosure may be practiced without one or more of the specific details, or other methods, components, materials, and the like may be employed. In other instances, well-known structures, materials, or operations are not shown or described in detail to avoid obscuring aspects of the present disclosure.

The phrase "about" or "around" as used in this specification generally means within 20%, preferably within 10%, and more preferably within 5% of a given value or range. The quantities given herein are an approximate quantity, that is, the meaning of "about", "around", "approximately", and "substantially" may be implied, unless otherwise specified.

Although the relative terms such as "on" and "below" are used in the specification to describe the relative relationship of one component to another component illustrated in the figure, these terms are used in this specification for convenience only, for example, according to the exemplary direction in accompanying drawings. It will be understood that if the device as illustrated is flipped upside down, the component described as "on" will become the component "below". Other relative terms such as "front", "back", "left", and "right" have similar meanings. When a structure is "on" another structure, it may mean that a structure is integrally formed on another structure, or that a structure is "directly" disposed on another structure, or that a structure is "indirectly" disposed on another structure through other structure.

In the present specification, the terms "a", "an", "the", "said", and "at least one" are used to mean the presence of one or more elements/components, etc. The terms "including" and "having" are used to mean an open type inclusion and means that there may be additional elements/components/etc. in addition to the listed elements/components/etc.

It should be understood that the present disclosure does not limit its application to the detailed structure and arrangement of the components proposed in the present specification. The present disclosure may have other embodiments and may be implemented and performed in a variety of manners. The foregoing variations and modifications are within the scope of the present disclosure. It is to be understood that the present disclosure disclosed and claimed herein extends to all alternative combinations of two or more individual features that are mentioned or apparent in the description and/or the accompanying drawings. All of these different combinations constitute a number of alternative aspects of the present disclosure. The embodiments described in the specification are illustrative of the best mode for carrying out the present disclosure and will enable those skilled in the art to utilize the present disclosure.

What is claimed is:

1. A microfluidic particle provided on a digital microfluidic chip, comprising:

a charged liquid droplet being a hydrophilic substance containing active substances of cells, DNAs, or proteins;

an intermediate cladding layer having hydrophobicity and continuously coated outside of the charged liquid droplet, wherein the intermediate cladding layer comprises: carboxymethylcellulose or soy protein isolate; and dielectric surface layer having hydrophilicity and continuously coated outside the intermediate cladding layer, wherein the intermediate cladding layer and the dielectric surface layer form a neutral microcapsule structure with a hydrophilic outer surface and a hydrophobic inner surface.

2. The microfluidic particle according to claim 1, wherein the charged liquid droplet has positive charges.

3. The microfluidic particle according to claim 1, wherein the dielectric surface layer comprises a silica nanoparticle.

4. The microfluidic particle according to claim 1, wherein the charged liquid droplet has a volume larger than or equal to 0.1 mm3 and smaller than or equal to 10 mm3, the intermediate cladding layer has a thickness larger than or equal to 1 nm and smaller than or equal to 10 nm, and the dielectric surface layer has a thickness larger than or equal to 1 nm and smaller than or equal to 10 nm.

5. The microfluidic particle according to claim 1, wherein the digital microfluidic chip comprises:

a substrate; and an electrode haying a hydrophobic surface disposed over the substrate, wherein the electrode is in direct contact with a flow channel, and the microfluidic particle is contained the flow channel.

6. The microfluidic particle according to claim 5, wherein the electrode is made of graphene.

7. A method, comprising:

manufacturing a microfluidic particle by:

forming a charged liquid droplet being a hydrophilic substance containing active substances of cells, DNAs, or proteins;

continuously coating a hydrophobic intermediate cladding layer outside of the charged liquid droplet; and continuously coating a hydrophilic dielectric surface layer outside the intermediate cladding layer, wherein the intermediate cladding layer comprises: carboxymethylcellulose or soy protein isolate, wherein the intermediate cladding layer and the dielectric surface layer form a neutral microcapsule structure with a hydrophilic outer surface and a hydrophobic inner surface; and providing the microfluidic particle on a digital microfluidic chip.

8. The method according to claim 7, further comprising:

forming the digital microfluidic chip having a hydrophobic surface; and dropping the microfluidic particle onto the hydrophobic surface of the digital microfluidic chip.

9. The method according to claim 8, wherein forming the digital microfluidic chip having the hydrophobic surface comprises: forming an electrode on a substrate, the electrode having the hydrophobic surface.

10. The method according to claim 9, further comprising forming a flow channel, wherein the electrode is in direct contact with the flow channel, and the microfluidic particle is contained in the flow channel.

11. The method according to claim 9, wherein a material of the electrode is graphene.

12. A method for driving a microfluidic system, comprising changing a voltage of electrodes to drive a microfluidic particle according to claim 1 to move.

13. A method, comprising:

providing a microfluidic particle on a digital microfluidic chip, the microfluidic particle comprising:

a charged liquid droplet being a hydrophilic substance containing active substances of cells, DNAs, or proteins;

an intermediate cladding layer having hydrophobicity and continuously coated outside of the charged liquid droplet, wherein the intermediate cladding layer comprises: carboxymethylcellulose or soy protein isolate; and a dielectric surface layer having hydrophilicity and continuously coated outside the intermediate cladding layer, wherein the intermediate cladding layer and the dielectric surface layer form a neutral microcapsule structure with a hydrophilic outer surface and a hydrophobic inner surface.

* * * * *